US011332903B1

(12) United States Patent
Lu et al.

(10) Patent No.: US 11,332,903 B1
(45) Date of Patent: May 17, 2022

(54) PENETRATING METHOD OF SELF-ADJUSTING HYDRAULIC STATIC PENETRATING DEVICE SUITABLE FOR SEABED SLOPE AREA

(71) Applicant: Qingdao Institute of Marine Geology, Qingdao (CN)

(72) Inventors: Kai Lu, Qingdao (CN); Huiliang Yang, Qingdao (CN); Yuan Yang, Qingdao (CN); Panfeng Li, Qingdao (CN); Jingtao Zhao, Qingdao (CN); Rui Shan, Qingdao (CN); Yiyong Yu, Qingdao (CN); Jun Sun, Qingdao (CN)

(73) Assignee: QINGDAO INSTITUTE OF MARINE GEOLOGY, Qingdao (CN)

( * ) Notice: Subject to any disclaimer, the term of this patent is extended or adjusted under 35 U.S.C. 154(b) by 0 days.

(21) Appl. No.: 17/483,788

(22) Filed: Sep. 23, 2021

(51) Int. Cl.
*E02B 17/08* (2006.01)
*E02B 17/06* (2006.01)

(52) U.S. Cl.
CPC ..... *E02B 17/0818* (2013.01); *E02B 17/06* (2013.01)

(58) Field of Classification Search
CPC ..... E02B 17/0818; E02B 17/06
See application file for complete search history.

(56) References Cited

U.S. PATENT DOCUMENTS 3,533,478 A * 10/1970 Tissier ..... E21B 7/124 173/37
3,866,697 A * 2/1975 Rossfelder ..... E21B 43/017 175/5
5,975,805 A * 11/1999 Morvan ..... E02B 17/0818 405/196
8,152,411 B2 * 4/2012 Ottesen ..... E21B 17/012 405/172

FOREIGN PATENT DOCUMENTS

CN 109094742 A 12/2018
CN 109444981 A 3/2019
CN 109823485 A 5/2019

* cited by examiner

*Primary Examiner* — Janine M Kreck
(74) *Attorney, Agent, or Firm* — Bayramoglu Law Offices LLC

(57) ABSTRACT

A self-adjusting hydraulic static penetrating device and method suitable for a seabed slope area is provided. The device includes an upper adjustable injection platform and a lower adjustable supporting platform. The upper adjustable injection platform is fixedly connected with the upper surface of the lower adjustable supporting platform. The upper adjustable injection platform includes a rack, a control cabin, an injection mechanism, a hydraulic station, a balance weight and first jacks. The control cabin, the injection mechanism, the hydraulic station, the balance weight and the first jacks are all arranged on the rack. The four first jacks are installed at the bottom of a steel structure frame, and the first jacks are fixed to the lower adjustable supporting platform. The device is simple in structure and low in cost, and can guarantee, to the maximum extent, that the overall gravity center of the device is always constant or slightly changes.

4 Claims, 8 Drawing Sheets

PENETRATING METHOD OF SELF-ADJUSTING HYDRAULIC STATIC PENETRATING DEVICE SUITABLE FOR SEABED SLOPE AREA

TECHNICAL FIELD

The present invention relates to the field of deep-sea sediment detection and sampling, and in particular, to a penetrating method of a self-adjusting hydraulic static penetrating device suitable for a land slope area.

BACKGROUND

To know more about the ocean, we need to greatly rely on the progress in the marine detection and monitoring technology and the use of detection equipment that is industrialized through the technology as human beings cannot live in the ocean. Through the efforts made in the recent half century, China has made great development in marine science, marine technology and marine equipment. Especially in recent years, China has developed marine equipment with a great number of independent intellectual property rights in the marine field upon the implementation of Marine Great Power strategy, thereby making a great number of influential and world-first-class achievements. Such equipment and achievements have provided advanced technical means for research on marine science and marine engineering as well as safety guarantee for construction of marine engineering such as offshore wind power and sub-sea tunnels, and promoted flourishing of the marine detection and monitoring technology in China. At present, the marine detection and monitoring technology and equipment in China are thriving, thereby providing tremendous novel power for innovation of marine science in China.

Objects of different subjects may be different for marine detection and monitoring. In addition to the conventional objects such as waves, tides and flow of the ocean, engineering properties of seabed sediments are the most important detection and monitoring objective for marine engineering. A penetrating method is the best and most common method for measuring the engineering mechanics properties of the seabed sediments at present. Various parameters of the sediments are obtained by penetrating various feeler levers into the seabed sediments in a static or dynamic mode.

To observe the seabed sediments for a long time in situ by virtue of the penetrating type feeler levers, the technical means adopted at present mainly include four modes: a gravity penetration method, a piling penetration method, a drilling penetration method and a static penetration method.

The gravity penetration method refers to controlling a penetrating body to enter the sediments by controlling the dropping speed of a rope or precisely calculating a form, buoyant weight and a center-of-gravity position of the penetrating body through a method like motion of a free-falling object. The equipment is easy to manufacture, but it is very difficult to achieve a penetrating process with a specified posture at a specified depth as expected and guarantee the equipment safety due to influences of equipment processing precision, calculating errors and a construction site.

The piling penetration method often refers to firstly controlling the penetrating body to enter a soil body through the gravity penetration method and then controlling the penetrating body to reach the specified depth by repeatedly piling through internal or external piling equipment. Compared with the gravity penetration method, the method has the advantages of greatly lowering requirements for calculation and the equipment shape. However, it is difficult to effectively control the posture of the penetrating body in a piling process, and then vibration generated in the piling process will exert great disturbance on surrounding sediments.

Based on the conventional drilling method, the drilling penetration method refers to arranging the penetrating body into the seabed sediments through a drill tube after pore-forming, and then penetrating by backfilling. The method is stable and reliable, but is high in cost, long in time period and poor in fit between the penetrating feeler levers and the sediments, thereby resulting in infective observation.

Based on the bottom static penetration technology, the static penetration method refers to feeding the penetrating body into a specified position in the sediments through a mechanical hand via a bottom-supported type penetrating platform under drive of a motor, a hydraulic press or the like. The method is stable and reliable, easily realizes control on posture and depth, and is a relatively safe and precise penetrating method. The static penetration method is also the most common method of the current feeler lever, where a penetrating device is stably supported on a seabed surface for directly and continuously penetrating a feeler into a seabed to acquire to-be-measured data. The matched feeler lever may be suitable for an in-situ test of the soil body, and an in-situ detection feeler lever with various sensors is installed on a conical head.

The static penetration method requires arranging the penetrating device onto the seabed surface. Once the seabed surface is a slope, the device will tilt on the seabed surface. The center of gravity offsets in a downward direction, as a result, a downward-direction supporting leg of the penetrating device will bear greater force. The downward-direction supporting leg is liable to sink into the sediments, such that the penetrating device is neither parallel to the slope nor parallel to the horizontal plane. The penetrating platform only can guarantee that the feeler levers penetrate in a direction perpendicular to the bottom surface of the penetrating device in the penetrating process, cannot guarantee that the feeler levers vertically penetrate into a stratum of the sediments or penetrate into the stratum in a direction perpendicular to the slope in the penetrating process. The data obtained by the feeler levers are neither change values in the vertical direction of the stratum nor change values in the direction perpendicular to the stratum, which causes later-stage data processing to be complex, and data results to be difficult to use on marine engineering.

SUMMARY

To overcome the defects in the prior art, the present invention discloses a self-adjusting hydraulic static penetrating device and a method suitable for a land slope area. The device is simple in structure and low in cost, is convenient to use, can guarantee, to the maximum extent, that the overall gravity center of the device is always constant or slightly changes, and is prevented against single-side sinking or overall overturning caused by downward movement or uneven stress of the gravity center in the penetrating process.

The present invention adopts the following technical scheme: a self-adjusting hydraulic static penetrating device suitable for a land slope area includes an upper adjustable injection platform and a lower adjustable supporting platform, where the upper adjustable injection platform is fixedly connected with the upper surface of the lower adjustable supporting platform, and the upper adjustable injection platform includes a rack, a control cabin, a penetrating mechanism, a hydraulic station, a balance weight and jacks I; the control cabin, the penetrating mechanism, the hydraulic station, the balance weight and the jacks I are all arranged on the rack, the four jacks I are installed at the bottom of a steel structure frame, and the jacks I are fixed to the lower adjustable supporting platform.

The penetrating mechanism includes a supporting frame, a plurality of groups of pulleys, a feeler lever, a movable mechanical clamping hand, a fixed mechanical clamping hand and an oil cylinder, where the plurality of groups of the pulleys, the feeler lever, the movable mechanical clamping hand, the fixed mechanical clamping hand and the oil cylinder are arranged on the supporting frame; the fixed mechanical clamping hand is fixedly arranged on a lower part of the supporting frame; the movable mechanical clamping hand is positioned above the fixed mechanical clamping hand; slide rails in the vertical direction are arranged at two sides of the movable mechanical clamping hand; the slide rails are fixedly arranged on the supporting frame; the movable mechanical clamping hand is connected with the oil cylinder through a steel wire; the movable mechanical clamping hand moves vertically along the slide rails; a feeler lever guide sleeve is arranged on the bottom of the supporting frame; the feeler lever sequentially passes through the feeler lever guide sleeve, the fixed mechanical clamping hand and the movable mechanical clamping hand; and a gyroscope I is fixedly arranged on the top of the balance weight.

The lower adjustable supporting platform includes a housing and jacks II, a hole 1 allowing the feeler lever to pass through is formed in the middle of the housing, the jacks II are respectively arranged at the four corners of the bottom of the housing, and a gyroscope II is arranged in the lower adjustable supporting platform.

In the present invention, the rack includes a steel structure frame and semi-open protective plates, where a bearing hook is arranged on the top of the steel structure frame, the semi-open protective plates are positioned on the four side surfaces of the steel structure frame, the semi-open protective plates are punched steel plates, and upper parts and lower parts of the semi-open protective plates are reinforced with beams, so that the stability of the overall structure is guaranteed. The semi-open protective plates are used for protecting structures inside against dropping, and also have certain weakening effect on seabed subterranean flow.

The control cabinet is a high-pressure-resistant sealed cabinet body, and a battery, a signal transmission mechanism and a control mechanism are arranged in the control cabinet and are mainly used power supply, data storage, data transmission, posture control, and the like.

The hydraulic station includes a hydraulic pump, a drive electric motor, an oil tank, a directional valve, a throttle valve and an overflow valve, where the hydraulic station is connected with the control mechanism through the oil tube. Oil is supplied according to a flow direction, pressure and a flow rate required by the control mechanism, so that the hydraulic mechanism can realize various specified actions.

The feeler lever can be replaced with a sediment sampler, so that detection, monitoring and sampling of the seabed sediments can be integrated, and thus, cost waste of different devices is avoided.

The plurality of groups of the pulleys include an upper fixed pulley group, a lower fixed pulley group and a movable pulley group, where the upper fixed pulley group is positioned on an upper part of the supporting frame, the lower fixed pulley group is positioned on a lower part of the supporting frame, and the movable pulley group is positioned on a middle part of the supporting frame. The movable pulley group, the lower fixed pulley group and the upper fixed pulley group are used for sliding the steel wire in the penetrating or withdrawing process to assist in arranging or withdrawing of the feeler lever.

The present invention further discloses a penetrating method of the self-adjusting hydraulic static penetrating device suitable for a land slope area, including the following steps:

Step 1, putting the device into seawater, and dropping the device on a seabed surface:

putting the device into seawater through a rope and dropping the device onto the seabed surface, transmitting a posture condition, on the seabed surface, of the device through a gyroscope II, thereby obtaining an angle of a seabed slope;

Step 2, adjusting the height of the jacks I and the jacks II to enable the feeler lever to penetrate into a stratum in a vertical direction or at an angle perpendicular to the seabed surface:

respectively calculating to-be-lifted heights of the four jacks II according to the angle obtained in step 1 of the seabed slope while the feeler lever needs to penetrate into the stratum in the vertical direction, to guarantee that the lower adjustable supporting platform is horizontal;

setting an angle of the seabed slope to be alpha, setting the height of the lower adjustable supporting platform to be $h_1$, setting the length of the lower adjustable supporting platform to be a, setting the height of the upper adjustable penetrating platform to be $h_2$, setting the length of the upper adjustable penetrating platform to be b, and lifting the two jacks II at the low positions by $\sqrt{(a\cos\alpha-a)^2+(a\sin\alpha)^2}$ while the lower adjustable supporting platform is in the horizontal state;

when the feeler lever needs to penetrate into the stratum at the angle perpendicular to the seabed surface, lifting the two jacks II at the low positions by $\sqrt{(a\cos\alpha-a)^2+(a\sin\alpha)^2}$, lifting the two jacks I towards the high position of the seabed surface by $$h_1 - \frac{h_1}{\cos\alpha} + \frac{a+b}{2}\sin\alpha$$

after the lower adjustable adjusting platform is adjusted to be in the horizontal state, performing angle adjustment on the upper adjustable penetrating platform, and feeding back information through the gyroscope I to guarantee that the upper adjustable penetrating platform is parallel to the seabed surface;

Step 3, penetrating the feeler lever into the stratum of the sediments; and

Step 4, withdrawing the feeler lever.

In step 1, the feeler lever sequentially passes through the feeler lever guide sleeve, the fixed mechanical clamping hand and the movable mechanical clamping hand, the lower end of the feeler lever passes through the hole of the feeler lever guide sleeve, and the fixed mechanical clamping hand and the movable mechanical clamping hand both clamp the feeler lever.

Step 3 specifically includes the following steps:

Step 3.1, clamping the feeler lever by the movable mechanical clamping hand, loosening the feeler lever by the fixed mechanical clamping hand, providing power by the hydraulic station and the oil cylinder, connecting a steel wire to the movable mechanical clamping hand through an upper fixed pulley group, a movable pulley group and a lower fixed pulley group, downwards moving the movable mechanical clamping hand on slide rails, downwards moving the feeler lever at a uniform speed under guide of the feeler lever guide sleeve, and finally penetrating the feeler lever into the stratum through the hole in a downward vertical direction or a direction perpendicular to the seabed surface.

Step 3.2, after the movable mechanical clamping hand accomplishes a stoke, clamping the feeler lever by the fixed mechanical clamping hand, loosening the feeler lever by the movable mechanical clamping hand, upwards moving the feeler lever along the slide rails to reach an arranging stoke start point;

repeating step 3.1 and step 3.2 until the feeler lever penetrates into the specified depth at the stratum of the sediments.

In step 4, the feeler lever is clamped by the movable mechanical clamping hand and loosened by the fixed mechanical clamping hand; after the movable mechanical clamping hand upwards moves at a uniform speed along the slide rails to accomplish one stroke, the feeler lever is clamped by the fixed mechanical clamping hand and loosened by the movable mechanical clamping hand, and finally downwards moves to the withdrawing stroke start point until the withdrawing of the feeler lever is accomplished by repeating the actions.

The present invention has the following beneficial effects:

By adoption of the dual-layer design, the device can adjust the angle twice on the seabed slope to guarantee the penetrating posture of the feeler lever, realize penetrating of the feeler lever in the vertical direction or a direction perpendicular to the stratum and obtaining data that can reflect a true stratum condition. In such a manner, the data obtained by the feeler lever can reflect a true stratum condition or directly serve marine engineering without later-stage complex angle adjustment. The device can guarantee, to the maximum extent, that the overall gravity center of the device is always constant or slightly changes, and is protected against single-side sinking or overall overturning caused by downward movement or uneven stress of the gravity center in the penetrating process, so that the data obtained by the feeler lever can directly serve various marine engineering, and thus, engineering safety is guaranteed, and further development of the marine detection and monitoring technology is promoted.

In the figures: 1, upper adjustable penetrating platform; 2, lower adjustable supporting platform; 3, weighing hook; 4, steel structure frame; 5, semi-open protective plate; 6, hydraulic station; 7, jack I; 8, control cabinet; 9, penetrating mechanism; 11, balance weight; 12, gyroscope II; 13, hole; 14, jack II; 15, feeler lever; 16, movable mechanical clamping hand; 18, fixed movable pulley group; 20, fixed mechanical clamping hand; 21, feeler lever guide sleeve; 22, slide rail; 23, oil cylinder; 24, lower fixed pulley group; and 25, upper fixed pulley.

DETAILED DESCRIPTION OF THE EMBODIMENTS

In order to make the above-mentioned objectives, features and advantages of the present invention more obvious and understandable, the specific embodiments of the present invention will be described in detail below with reference to the accompanying drawings.

In the following description, specific details are set forth for a comprehensive understanding of the present invention. However, the present invention can be implemented in many other ways different from those described herein, and a person skilled in the art can make similar generalizations without departing from the connotation of the present invention. Therefore, the present invention is not limited by the specific embodiments disclosed below.

Figure 1:
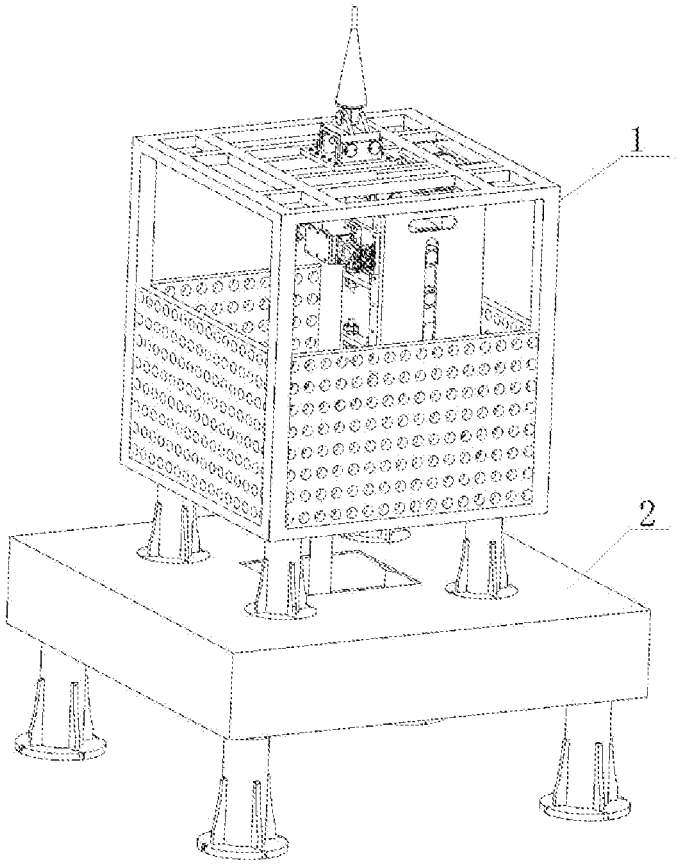
FIG. 1 is a structural diagram of the present invention.
Figure 2:
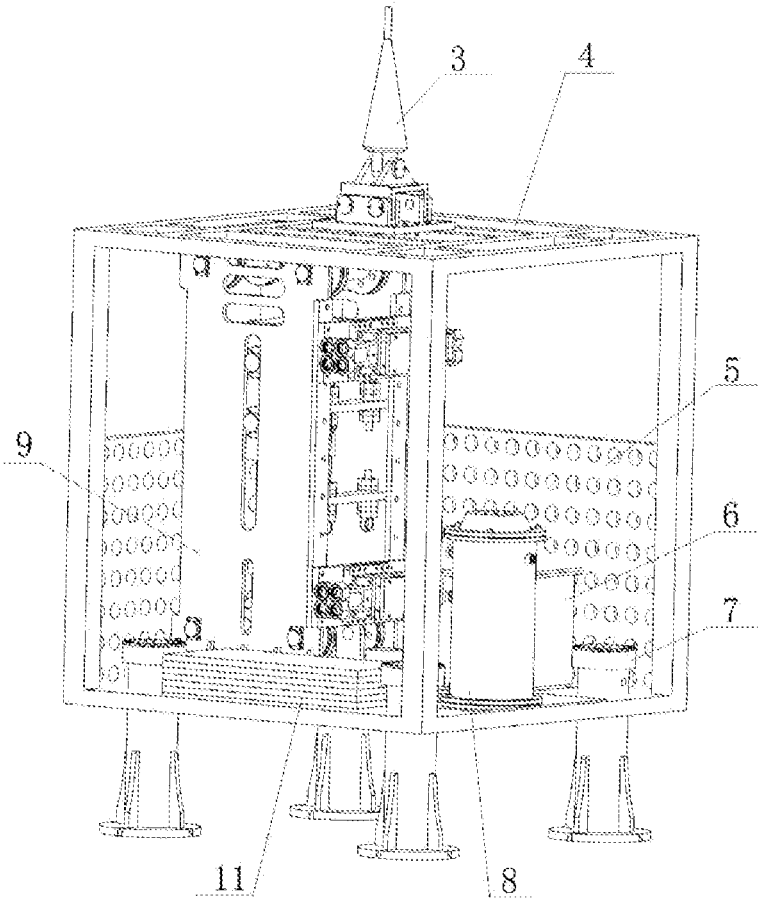
FIG. 2 is a structural diagram of an upper adjustable penetrating platform.

As shown in FIG. 1, the self-adjusting hydraulic static penetrating device suitable for a land slope area includes an upper adjustable penetrating platform 1 and a lower adjustable supporting platform 2, where the upper adjustable penetrating platform 1 is fixedly arranged on the lower adjustable supporting platform 2. As shown in FIG. 2, the upper adjustable penetrating platform 1 is a working main body part of the device, and includes a rack, a control cabin 8, a penetrating mechanism 9, a hydraulic station 6, a balance weight 11 and jacks I 7, where the control cabin 8, the penetrating mechanism 9, the hydraulic station 6, the balance weight 11 and the jacks I 7 are all arranged on the rack; the rack includes a steel structure frame 4 and semi-open protective plates 5, where a bearing hook 3 which is connected with the rope while the device is arranged on the seabed or withdrawn onto a deck is arranged on the top of the steel structure frame 4, so that the device is guaranteed to be kept stable and not missing in the arranging or withdrawing process. The semi-open protective plates 5 are positioned on the four side surfaces of the steel structure frame 4, the semi-open protective plates 5 are punched steel plates, and upper parts and lower parts of the semi-open protective plates 5 are reinforced with beams, so that the stability of the overall structure is guaranteed. The semi-open protective plates 5 are used for protecting structures inside against dropping, and also have certain weakening effect on seabed subterranean flow. Four jacks I 7 are installed on the bottom of the steel structure frame 4 and are driven by the electric motor, so that height of each jack I 7 can be independently adjusted or integrally adjusted. The dip angle of the upper adjustable penetrating platform 1 can be adjusted by adjusting the four jacks I 7, so that the feeler lever perpendicularly penetrates into the sediments perpendicular to the stratum or at certain dip angle with the stratum; and the jacks I 7 are fixedly arranged on the lower adjustable supporting platform 2. A gyroscope I which is used as a sensitive element is fixedly arranged on the top of the balance weight 11 to provide signals such as accurate direction, level, position, speed and accelerated speed, so that the jacks I 7 can conveniently reach preset height; and it is guaranteed that the upper adjustable penetrating platform 1 is horizontal or reaches a preset angle.

The control cabinet 8 is a high-pressure-resistant sealed cabinet body, a battery, a signal transmission mechanism and a control mechanism are arranged in the sealed cabinet body and are mainly used for power supply, data storage, data transmission, posture control, and the like.

The hydraulic station 6 is a hydraulic source device or a hydraulic mechanism including a control valve therein, and includes a hydraulic pump, a drive electric motor, an oil tank, a directional valve, a throttle valve and an overflow valve, where the hydraulic station is connected with the control mechanism through an oil tube to supply oil with a flow direction, pressure and flow rate required by the control mechanism, so that the hydraulic mechanism can realize various specified actions.

The balance weight 11 is mainly used for increasing the weight of the device to balance the gravity center of the device, so that an eccentric load is prevented from being generated on the lower part of the device; and meanwhile, penetrating force can be increased, so that the whole device will not be not supported by counterforce in the penetrating process.

Figure 4:
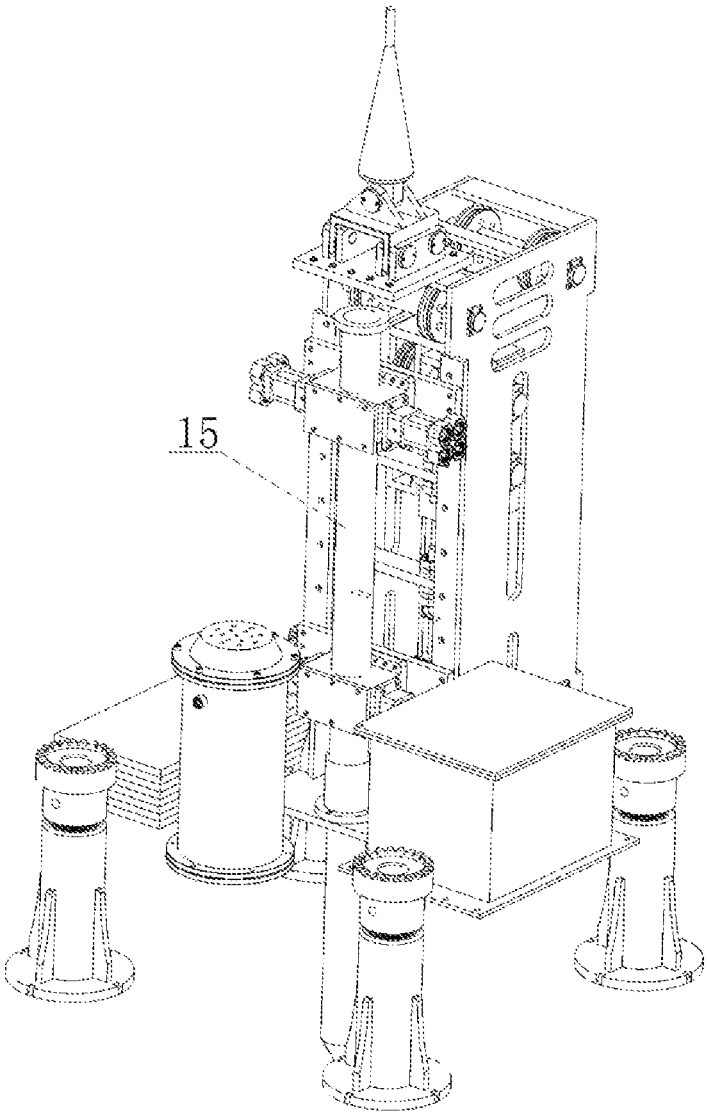
FIG. 4 is a structural diagram of a feeler lever and a penetrating mechanism.
Figure 5:
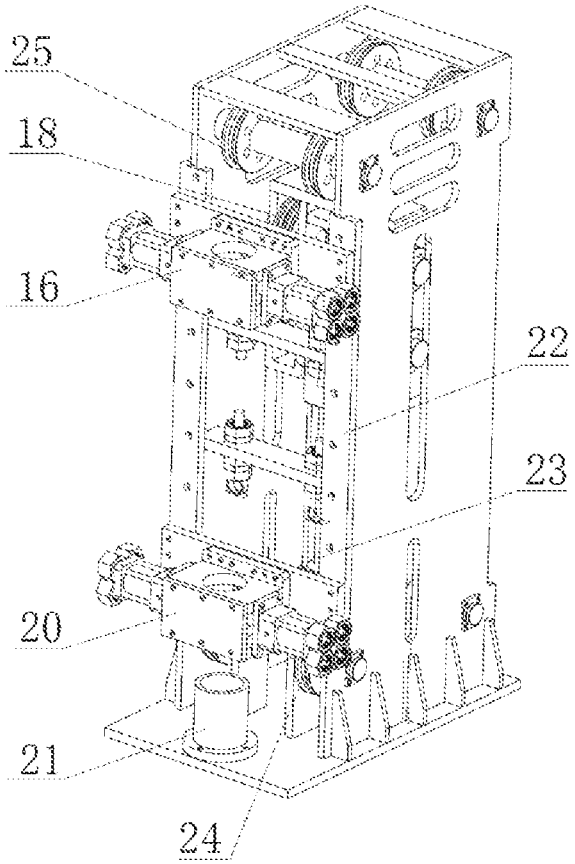
FIG. 5 is a structural diagram of a penetrating mechanism.

As shown in FIG. 4 and FIG. 5, the penetrating mechanism 9 includes a supporting frame, a plurality of groups of pulleys, a feeler lever 15, a movable mechanical clamping hand 16, a fixed mechanical clamping hand 20 and an oil cylinder 23, where the plurality of groups of the pulleys, the feeler lever 15, the movable mechanical clamping hand 16, the fixed mechanical clamping hand 20 and the oil cylinder 23 are arranged on the supporting frame. The fixed mechanical clamping hand 20 is fixedly arranged on the lower part of the supporting frame and the movable mechanical clamping hand 16 is positioned above the fixed mechanical clamping hand 20; slide rails 22 in the vertical direction are arranged at two sides of the movable mechanical clamping hand 16; the slide rails 22 are fixedly arranged on the supporting frame; the movable mechanical clamping hand 16 is connected with the steel wire; and under pulling of the steel wire, the movable mechanical clamping hand 16 can move vertically along the slide rails 22. Diesel oil is contained in the oil cylinder 23 to provide fuel power in a motion process of the feeler lever; and the oil cylinder 23 controls the steel wire to move, so that the pilot mechanical clamping hand ascends. Namely, the movable mechanical clamping hand 16 is connected with the oil cylinder 23 through the steel wire; and when the oil cylinder 23 acts, the steel wire drives the movable mechanical clamping hand 16 to move vertically.

A feeler lever guide sleeve 21 is arranged on the bottom of the supporting frame; the feeler lever 15 sequentially passes through the feeler lever guide sleeve 21, the fixed mechanical clamping hand 20 and the movable mechanical clamping hand 16; and the feeler lever guide sleeve 21 guarantees the posture of the feeler lever 15, so that the feeler lever 15 is guided. In the embodiment, the feeler lever 15 is made of a steel structure, and may be a CPT feeler lever, a pore pressure feeler lever, a specific resistance feeler lever or any other sensor which can be used for detection or monitoring in the form of the feeler lever, and may be a main detection tool of the device.

In the feeler lever penetrating or withdrawing process, the feeler lever 15 is clamped and fixed by the movable mechanical clamping hand 16 while the fixed mechanical clamping hand 20 is in a loose state; and the movable mechanical clamping hand 16 drives the fixed feeler lever 15 to vertically move in the process of moving vertically along the slide rails 22. When the movable mechanical clamping hand 16 loosens the feeler lever, the fixed mechanical clamping hand 20 clamps and fixes the feeler lever 15 to prevent the feeler lever from dropping.

In the embodiment, the plurality of groups of the pulleys include an upper fixed pulley group 25, a lower fixed pulley group 24 and a movable pulley group 18, where the upper fixed pulley group 25 is positioned on the upper part of the supporting frame, the lower fixed pulley group 24 is positioned on the lower part of the supporting frame, and the movable pulley group 18 is positioned on the middle part of the supporting frame. The movable pulley group 18, the lower fixed pulley group 24 and the upper fixed pulley group 25 are used for sliding the steel wire in the penetrating or withdrawing process to assist in arranging or withdrawing of the feeler lever.

Figure 3:
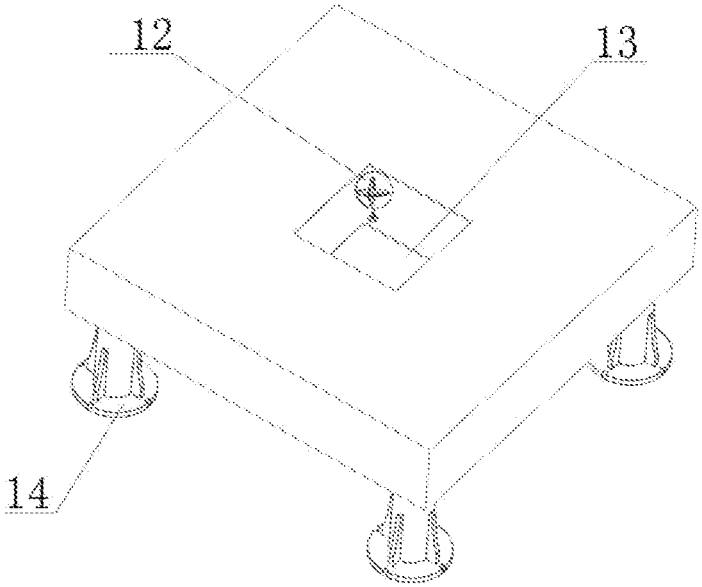
FIG. 3 is a structural diagram of a lower adjustable supporting platform.

As shown in FIG. 3, the lower adjustable supporting platform 2 includes a housing and jacks II 14, a hole 13 allowing the feeler lever to penetrate to leave a sufficient space is formed in the middle of the housing, so that the feeler lever can pass through the hole at any angle or can penetrate into the seabed sediments; the jacks II 14 are respectively arranged at the four corners of the bottom of the housing, and the height of each jack II 14 can be independently adjusted or integrally adjusted, so that it is guaranteed that the lower adjustable supporting platform 2 is kept in the horizontal state all the time on any seabed slope. A gyroscope II 12 is arranged in the lower adjustable supporting platform 2; and the gyroscope II 12 is used for detecting whether jacks II 14 reach preset height and guaranteeing that the lower adjustable supporting platform 2 is horizontal or reaches a preset angle. The lower adjustable supporting platform 2 achieves the effect of guaranteeing that the gravity center will not generate greater offset in the penetrating process, and providing enough supporting force.

The present invention further discloses a penetrating method of the self-adjusting hydraulic static penetrating device suitable for a land slope area, including the following steps:

Step 1, putting the device into seawater, and dropping the device on a seabed surface.

The feeler lever 15 sequentially passes through the feeler lever guide sleeve 21, the fixed mechanical clamping hand 20 and the movable mechanical clamping hand 16, the lower end of the feeler lever 15 passes through the hole of the feeler lever guide sleeve 21, and the fixed mechanical clamping hand 20 and the movable mechanical clamping hand 16 both clamp the feeler lever 15.

Figure 8:
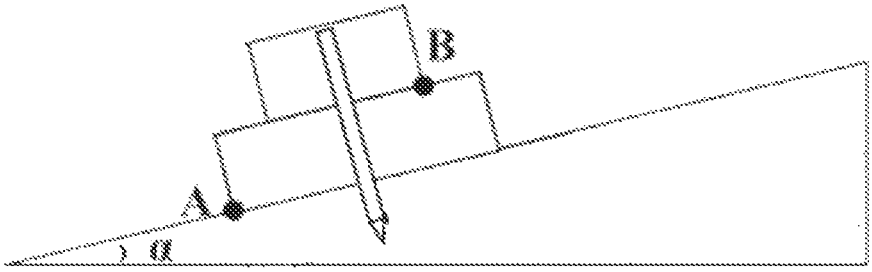
FIG. 8 is a structural diagram of putting the device onto a seabed surface.

The device is put into seawater through a rope and dropped onto the seabed surface; and as shown in FIG. 8, a posture condition, on the seabed surface, of the device is transmitted through a gyroscope II 12, so that an angle of a seabed slope is obtained.

Step 2, adjusting the height of the jacks I 7 and the jacks II 14 to enable the feeler lever 15 to penetrate into a stratum in a vertical direction or at an angle perpendicular to the seabed surface.

Figure 6:
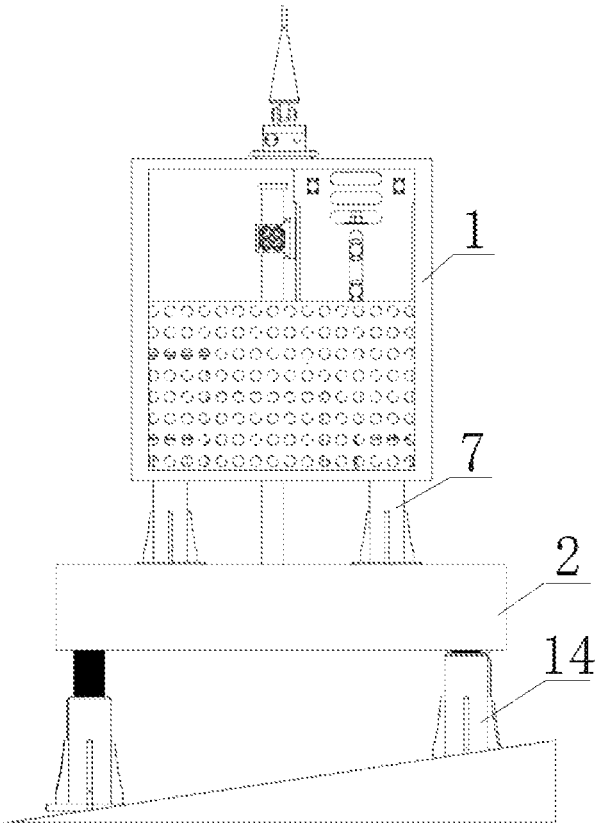
FIG. 6 is a schematic diagram of a first working state of the present invention.

To-be-lifted heights of the four jacks II 14 are respectively calculated according to the angle obtained in the first step of the seabed slope, so that it is guaranteed that the lower adjustable supporting platform 2 is horizontal, and the upper adjustable penetrating platform 1 also can be kept in the horizontal state. Whether the angle of the upper adjustable penetrating platform needs to be adjusted according to scientific needs is determined; if the feeler lever needs to vertically penetrate into the stratum according to the research, the state of the upper adjustable penetrating platform 1 is as shown in FIG. 6, and the device enters the working state of the feeler lever.

An angle of the seabed slope is set to be alpha, the height of the lower adjustable supporting platform 2 is set to be h1, the length of the lower adjustable supporting platform is set to be a, the height of the upper adjustable penetrating platform 1 is set to be $h_2$, and the length of the upper adjustable penetrating platform is set to be b. As shown in FIG. 8, coordinates of an initial point A in the figure are set to be (0, 0), and coordinates of a point B are set to be $$\left(\frac{a+b}{2}\cos\alpha,\ \frac{a+b}{2}\sin\alpha+\frac{h_1}{\cos\alpha}\right).$$

When the lower adjustable supporting platform 2 is in the horizontal state, the coordinates of the point A' are(a cos α−a, a sin α), that is, the jacks at the A need to lift by $\sqrt{(a\cos\alpha-a)^2+(a\sin\alpha)^2}$.

Figure 9:
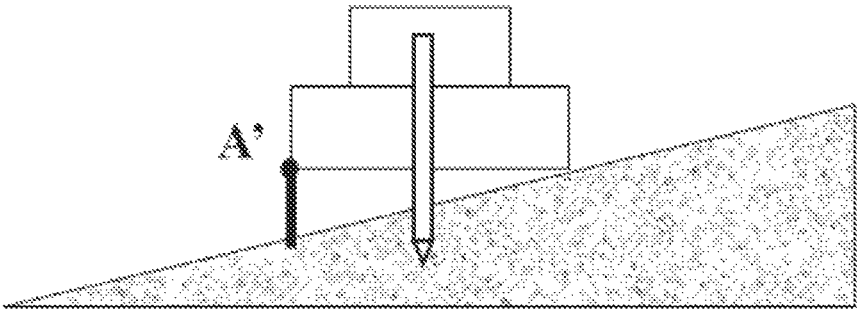
FIG. 9 is a structural diagram of vertically penetrating the device into a stratum.
Figure 10:
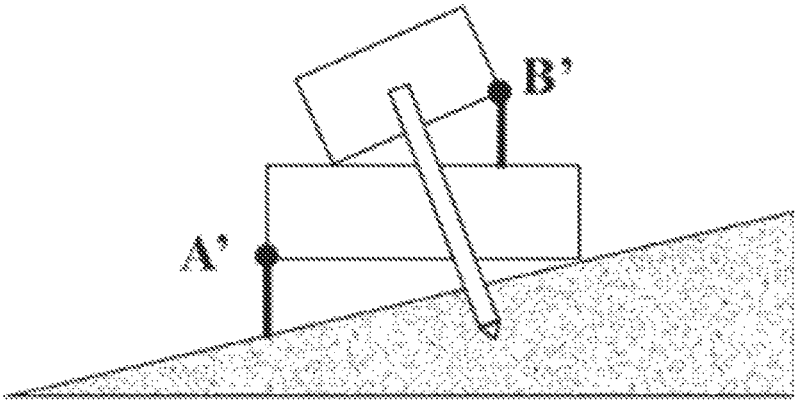
FIG. 10 is a structural diagram of vertically penetrating the device into the stratum.

When the device needs to vertically penetrate into the stratum, as shown in FIG. 9, the jacks II 14 at A need to lift by $\sqrt{(a\cos\alpha-a)^2+(a\sin\alpha)^2}$.

Figure 7:
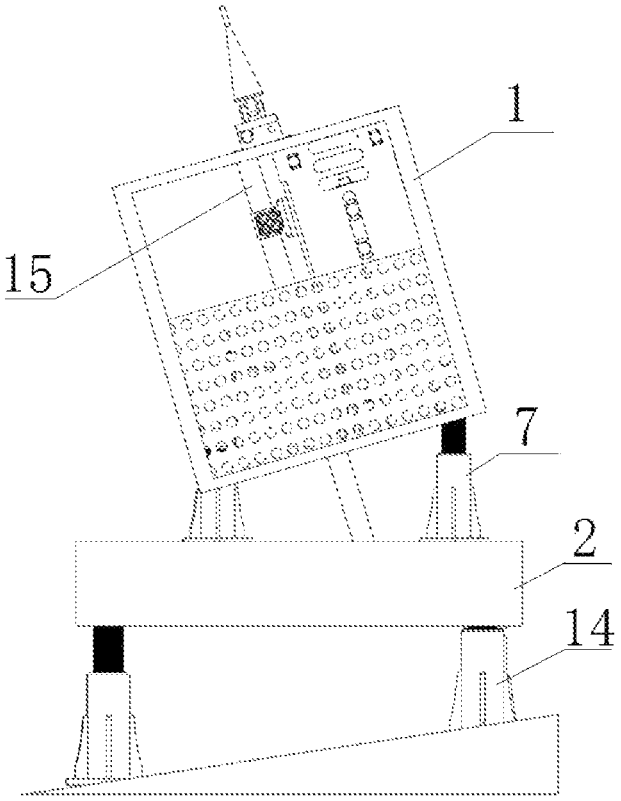
FIG. 7 is a schematic diagram of a second working state of the present invention.

If the study requires the feeler lever to penetrate into the stratum at an angle perpendicular to the seabed surface, the upper adjustable type penetrating platform 1 is subjected to angle adjustment after the lower adjustable supporting platform 2 is adjusted to be the horizontal state. Heights of the four jacks I 7 are respectively adjusted, and the gyroscope I feeds back information to guarantee that the upper adjustable type penetrating platform 1 is parallel to the seabed surface, and the working state of the device is as shown in FIG. 7.

When the upper adjustable type penetrating platform 1 parallel to the seabed surface, the coordinates of the point B' are $$\left(\frac{a+b}{2}\cos\alpha,\ h_1+a\sin\alpha+b\sin\alpha\right),$$

that is, the jacks I 7 on B need to lift by $$h_1-\frac{h_1}{\cos\alpha}+\frac{a+b}{2}\sin\alpha.$$

As a result, when the device needs to perpendicularly penetrates into the gravity center without offset, the jacks II 14 on A need to lift by $\sqrt{(a\cos\alpha-a)^2+(a\sin\alpha)^2}$, and the jacks I 7 on B need to lift by $$h_1-\frac{h_1}{\cos\alpha}+\frac{a+b}{2}\sin\alpha.$$

Step 3, penetrating the feeler lever into the stratum of the sediments.

The feeler lever 15 is clamped by the movable mechanical clamping hand 16 and loosened by the fixed mechanical clamping hand 20; power is provided by the hydraulic station 6 and the oil cylinder 23, a steel wire is connected to the movable mechanical clamping hand 16 through an upper fixed pulley group 25, a movable pulley group 18 and a lower fixed pulley group 24; the movable mechanical clamping hand 16 downwards moves on slide rails 22, so that the feeler lever 15 moves downwards at a uniform speed under guide of the feeler lever guide sleeve 21, and finally penetrates into the stratum through the hole 13 in a downward vertical direction or a direction perpendicular to the seabed surface.

Then, after the movable mechanical clamping hand 16 accomplishes a stoke, the feeler lever 15 is clamped by the fixed mechanical clamping hand 20 and is loosened by the movable mechanical clamping hand 16, and the feeler lever 15 moves upwards along the slide rails 2 to reach arranging an stoke start point.

The two steps are repeated until the feeler lever 15 penetrates into the specified depth at the stratum of the sediments.

Step 4, withdrawing the feeler lever.

In the withdrawing process of the feeler lever, the feeler lever 15 is clamped by the movable mechanical clamping hand 16 and is loosened by the fixed mechanical clamping hand 20; after the movable mechanical clamping hand 16 upwards moves along the slide rails 22 at a uniform speed to accomplish one stoke, the feeler lever 15 is clamped by the fixed mechanical clamping hand 20 and is loosened by the movable mechanical clamping hand 16, and then moves downwards to the withdrawing stroke start point. The actions are repeated until the withdrawing of the feeler lever 15 is accomplished.

The third step and the fourth step are repeated to accomplish the arranging and withdrawing work when the feeler lever is perpendicular to the stratum.

Step 5, the feeler lever 15 can be replaced with a sampler to accomplish the steps, so that static sampling of sediment cylindrical samples, in the vertical direction or the direction perpendicular to the stratum of the seabed sediments can be realized.

The above is a detailed description to the penetrating method of the self-adjusting hydraulic static penetrating device suitable for the land slope area provided by the present invention. Specific examples are used herein to illustrate the principle and embodiments of the present invention, which are only used to help understand the methods and core concept of the present invention. It should be noted that the improvements and the modifications made by a person of ordinary skill in the art without departing from the principle of the present invention shall be within the protection range of the claims of the present invention, The description of the disclosed embodiments enables a person skilled in the art to implement or use the present invention. Various modifications to the embodiments will be obvious to a person skilled in the art, and the general principle defined herein can be implemented in other embodiments without departing from the spirit or scope of the present invention. Therefore, the present invention will not be limited to the embodiments herein, but should conform to the widest scope consistent with the principles and novel features disclosed herein.

What is claimed is:

1. A penetrating method of a self-adjusting hydraulic static penetrating device suitable for a land slope area, wherein the self-adjusting hydraulic static penetrating device suitable for the land slope area comprises an upper adjustable injection platform and a lower adjustable supporting platform, wherein the upper adjustable injection platform is fixedly arranged on the lower adjustable supporting platform;

the upper adjustable injection platform comprises a rack, a control cabin, a penetrating mechanism, a hydraulic station, a balance weight and first jacks;

the control cabin, the penetrating mechanism, the hydraulic station, the balance weight and the first jacks are all arranged on the rack;

the four first jacks are installed at a bottom of a steel structure frame, and the first jacks are fixed to the lower adjustable supporting platform;

the penetrating mechanism comprises a supporting frame, a plurality of groups of pulleys, a feeler lever, a movable mechanical clamping hand, a fixed mechanical clamping hand and an oil cylinder, wherein the plurality of groups of the pulleys, the feeler lever, the movable mechanical clamping hand, the fixed mechanical clamping hand and the oil cylinder are all arranged on the supporting frame;

the fixed mechanical clamping hand is fixedly arranged on a lower part of the supporting frame;

the movable mechanical clamping hand is positioned above the fixed mechanical clamping hand;

slide rails in a vertical direction are arranged at two sides of the movable mechanical clamping hand;

the slide rails are fixedly arranged on the supporting frame;

the movable mechanical clamping hand is connected with the oil cylinder through a steel wire;

the movable mechanical clamping hand moves vertically along the slide rails;

a feeler lever guide sleeve is arranged on a bottom of the supporting frame;

the feeler lever sequentially passes through the feeler lever guide sleeve, the fixed mechanical clamping hand and the movable mechanical clamping hand; and a first gyroscope is fixedly arranged on a top of the balance weight;

the lower adjustable supporting platform comprises a housing and second jacks, wherein a hole allowing the feeler lever to pass through is formed in a middle of the housing;

the second jacks are respectively arranged at four corners of a bottom of the housing; and a second gyroscope is arranged in the lower adjustable supporting platform;

wherein, the penetrating method comprises the following steps:

step 1, putting the self-adjusting hydraulic static penetrating device into seawater, and dropping the self-adjusting hydraulic static penetrating device on a seabed surface:

putting the self-adjusting hydraulic static penetrating device into seawater through a rope and dropping the self-adjusting hydraulic static penetrating device onto the seabed surface, transmitting a posture condition, on the seabed surface, of the self-adjusting hydraulic static penetrating device through the second gyroscope, thereby obtaining an angle of a seabed slope;

step 2, adjusting heights of the first jacks and the second jacks to allow the feeler lever to penetrate into a stratum in a vertical direction or at an angle perpendicular to the seabed surface:

respectively calculating to-be-lifted heights of the four second jacks according to the angle of the seabed slope obtained in step 1 while the feeler lever needs to penetrate into the stratum in the vertical direction, to guarantee that the lower adjustable supporting platform is in a horizontal state;

setting the angle of the seabed slope to be $\alpha$, setting a height of the lower adjustable supporting platform to be h1, setting a length of the lower adjustable supporting platform to be a, setting a height of the upper adjustable penetrating platform to be h2, setting a length of the upper adjustable penetrating platform to be b, and lifting two second jacks at low positions by $\sqrt{(a\cos\alpha-a)^2+(a\sin\alpha)^2}$ while the lower adjustable supporting platform is in the horizontal state;

when the feeler lever needs to penetrate into the stratum at the angle perpendicular to the seabed surface, lifting the two second jacks at the low positions by $\sqrt{(a\cos\alpha-a)^2+(a\sin\alpha)^2}$, lifting two first jacks towards a high position of the seabed surface by $$h_1 - \frac{h_1}{\cos\alpha} + \frac{a+b}{2}\sin\alpha$$

after the lower adjustable supporting platform is adjusted to be in the horizontal state, performing angle adjustment on the upper adjustable penetrating platform, and feeding back information through the first gyroscope to guarantee that the upper adjustable penetrating platform is parallel to the seabed surface;

step 3, penetrating the feeler lever into the stratum of sediments; and step 4, withdrawing the feeler lever.

2. The penetrating method according to claim 1, wherein in step 1, the feeler lever sequentially passes through the feeler lever guide sleeve, the fixed mechanical clamping hand and the movable mechanical clamping hand, a lower end of the feeler lever passes through a hole of the feeler lever guide sleeve, and the fixed mechanical clamping hand and the movable mechanical clamping hand both clamp the feeler lever.

3. The penetrating method according to claim 1, wherein step 3 specifically comprises the following steps:

step 3.1, clamping the feeler lever by the movable mechanical clamping hand, loosening the feeler lever by the fixed mechanical clamping hand, providing power by the hydraulic station and the oil cylinder, connecting a steel wire to the movable mechanical clamping hand through an upper fixed pulley group, a movable pulley group and a lower fixed pulley group, downwards moving the movable mechanical clamping hand on the slide rails, downwards moving the feeler lever at a uniform speed under a guide of the feeler lever guide sleeve, and finally penetrating the feeler lever into the stratum through the hole in a downward vertical direction or a direction perpendicular to the seabed surface;

step 3.2, after the movable mechanical clamping hand accomplishes a stoke, clamping the feeler lever by the fixed mechanical clamping hand, loosening the feeler lever by the movable mechanical clamping hand, upwards moving the feeler lever along the slide rails to reach an arranging stoke start point; and repeating step 3.1 and step 3.2 until the feeler lever penetrates into a specified depth at the stratum of the sediments.

4. The penetrating method according to claim 1, wherein in step 4, the feeler lever is clamped by the movable mechanical clamping hand and loosened by the fixed mechanical clamping hand; after the movable mechanical clamping hand upwards moves at a uniform speed along the slide rails to accomplish one stroke, the feeler lever is clamped by the fixed mechanical clamping hand and is loosed by the movable mechanical clamping hand, and finally downwards moves to a withdrawing stroke start point until a withdrawing of the feeler lever is accomplished by repeating actions.

* * * * *